US009842475B2

(12) United States Patent
Chap et al.

(10) Patent No.: US 9,842,475 B2
(45) Date of Patent: Dec. 12, 2017

(54) ILLUMINATED CASH DRAWER

(71) Applicant: Block and Company, Inc., Wheeling, IL (US)

(72) Inventors: John P. Chap, Woodridge, IL (US); Ivelisse Gomez, Wheeling, IL (US); Paul E. Specht, Glenview, IL (US)

(73) Assignee: BLOCK AND COMPANY, INC., Wheeling, IL (US)

( * ) Notice: Subject to any disclaimer, the term of this patent is extended or adjusted under 35 U.S.C. 154(b) by 193 days.

(21) Appl. No.: 14/733,571

(22) Filed: Jun. 8, 2015

(65) Prior Publication Data

US 2016/0343214 A1 Nov. 24, 2016

Related U.S. Application Data

(60) Provisional application No. 62/165,041, filed on May 21, 2015.

(51) Int. Cl.

| | |
|---|---|
| ***G07G 1/00*** | (2006.01) |
| ***F21V 33/00*** | (2006.01) |
| *F21V 23/04* | (2006.01) |
| *F21Y 103/10* | (2016.01) |
| *F21Y 115/10* | (2016.01) |

(52) U.S. Cl.

CPC ..... *G07G 1/0027* (2013.01); *F21V 33/00* (2013.01); *F21V 23/04* (2013.01); *F21Y 2103/10* (2016.08); *F21Y 2115/10* (2016.08)

(58) Field of Classification Search

USPC ..... 235/10, 375, 2, 7 R

See application file for complete search history.

(56) References Cited

U.S. PATENT DOCUMENTS

| | | | | |
|---|---|---|---|---|
| 999,176 | A | 6/1911 | Wells | |
| 1,143,290 | A | 6/1915 | Lippincott | |
| 1,170,480 | A | 2/1916 | Duffie | |
| 1,294,167 | A | 2/1919 | Ribble | |
| 1,892,330 | A | 12/1932 | Cornyn | |
| 5,723,850 | A * | 3/1998 | Lambert | G07G 1/0027 200/DIG. 38 |
| 8,870,405 | B2 | 10/2014 | Chung | |
| 2009/0014544 | A1* | 1/2009 | Cox | G07G 1/0027 235/7 A |
| 2011/0253563 | A1* | 10/2011 | Goldman | A61L 2/10 206/216 |
| 2012/0068588 | A1* | 3/2012 | Specht | G07G 1/0027 312/293.1 |
| 2012/0233006 | A1* | 9/2012 | St. George | G07G 1/0018 705/18 |
| 2012/0273698 | A1* | 11/2012 | Gudgell | G07D 7/121 250/492.1 |
| 2013/0045133 | A1* | 2/2013 | Maguire | A61L 2/10 422/24 |
| 2013/0077345 | A1* | 3/2013 | Sato | G02B 6/0061 362/609 |

* cited by examiner

*Primary Examiner* — Edwyn Labaze

(74) *Attorney, Agent, or Firm* — Husch Blackwell LLP

(57) ABSTRACT

An illuminated cash drawer with the illumination mounted on the inside surface of the top of the case in which the drawer is located.

14 Claims, 2 Drawing Sheets

ILLUMINATED CASH DRAWER

This application claims the benefit of the filing date of U.S. provisional application Ser. No. 62/165,041, filed 21 May 2015.

This invention pertains to an illuminated cash drawer with the illumination mounted on the inside surface of the top of the case in which the drawer is located.

BRIEF DESCRIPTION OF THE DRAWINGS

The following drawings illustrate the concepts of the present invention, and are not necessarily drawn to scale.

DETAILED DESCRIPTION OF SOME EMBODIMENTS

Figure 1A:
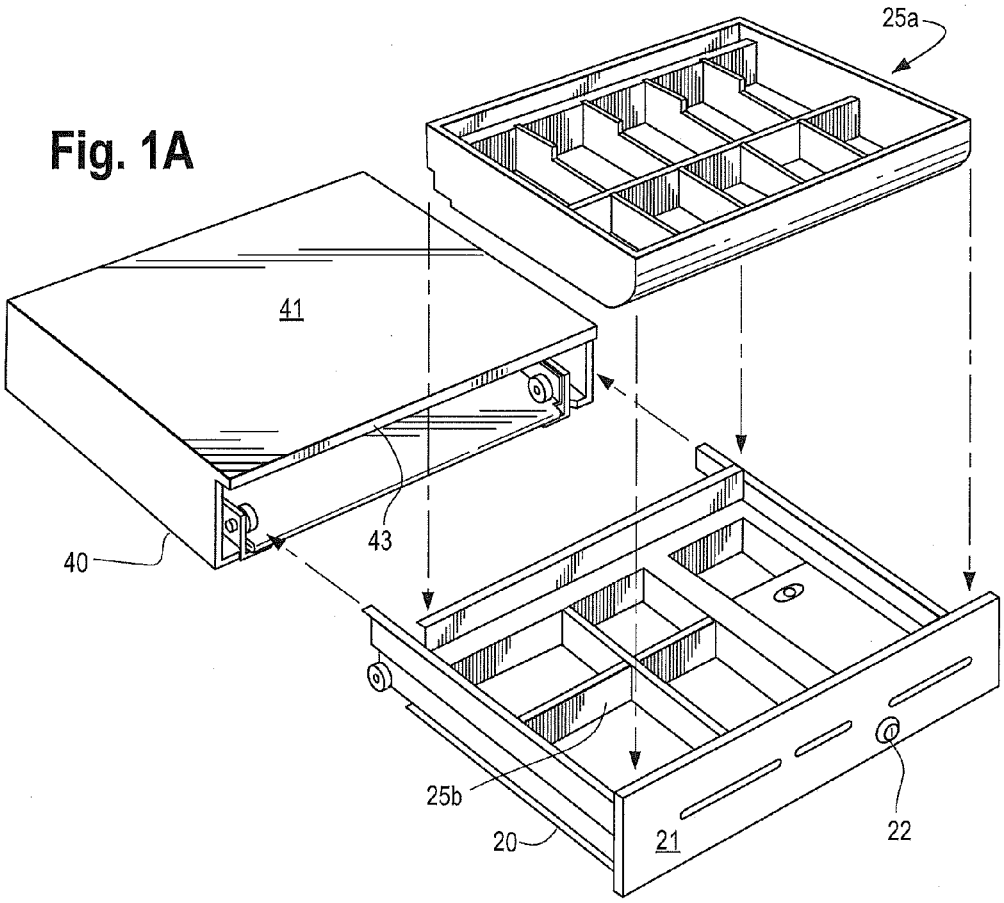
FIG. 1A illustrates an exploded perspective view of an embodiment.

While the present invention is susceptible of embodiment in various forms, there is shown in the drawings and will hereinafter be described some embodiments with the understanding that the present disclosure is to be considered an exemplification of the invention and is not intended to limit the invention to the specific embodiments illustrated or described.

Cash drawers are frequently used in environments where lighting is kept dim such as in some types of restaurants, bars, and entertainment venues in the hospitality industry. Therefore, it is advantageous to provide illumination in a cash drawer when it is open. In use, cash drawers are located in cases into which they fit and in which they can be locked. A case may be stand alone or may fit into a larger component such as a cash register.

Figure 1B:
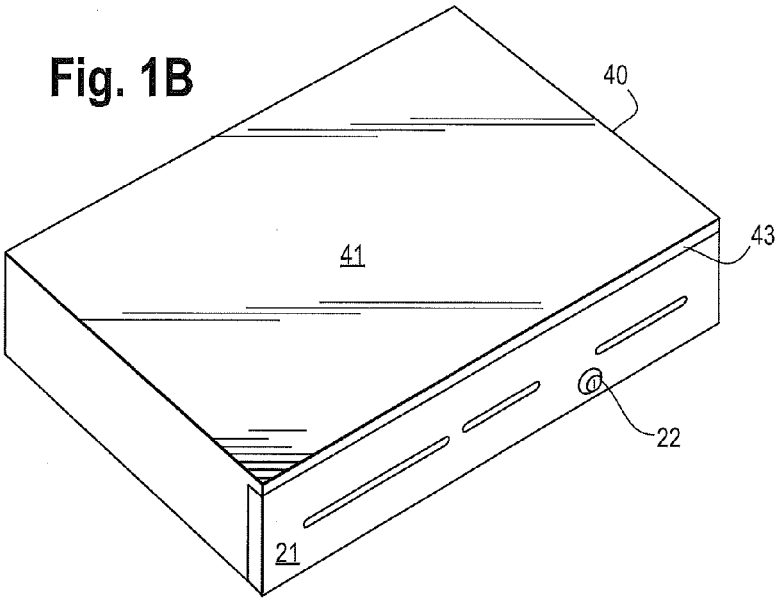
FIG. 1B illustrates a perspective view of the embodiment of FIG. 1 with the cash drawer closed.
Figure 2:
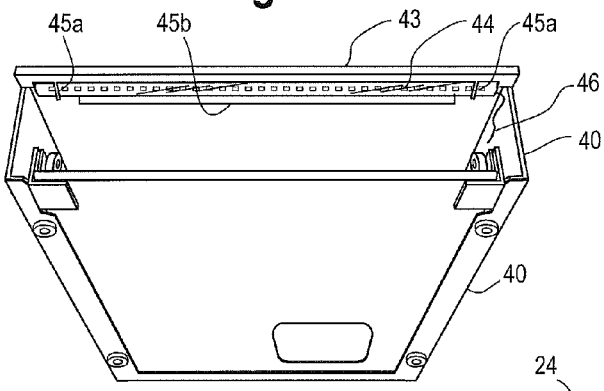
FIG. 2 illustrates a bottom front perspective view of the case with the cash drawer removed.

FIGS. 1A and 1B illustrate an example of a cash drawer 20 in a case 40. FIG. 1A shows an exploded view of the case 40, cash drawer 20 and upper tray 25*a*, and FIG. 1B shows the closed drawer 20 in the case 40. FIG. 2 illustrates a bottom front perspective view of case 40 with cash drawer 20 removed, showing an LED light strip 44 mounted on the inside surface of the top 41 of case 40, adjacent to and parallel to a front edge 43 of the top 41. The LED light strip 44 is held in place by mounts 45*a* and 45*b*. Wiring 46 electrically connects the LED light strip 44 to a remainder of the electrical circuit inside the rear of case 40. Partitions in the top cash tray 25*a* are lower than the front 21 of the cash drawer 20 to allow clearance past the LED light strip 44 when the cash drawer 20 is being opened or closed.

The illumination source is not limited to the LED light strip 44, but can be other means for providing illumination known in the art such as incandescent light bulbs. In the illustrated example, the mounts 45*a* and 45*b* are integral with respective parts of the metal case 40, but other means for mounting the illumination source can be used as is known in the art. For example, various types of clips can be fastened to the case 40, or a socket for the illumination source can be screwed, bolted, or welded to the case 40, or such a socket can be integral with the case 40.

Figure 3A:
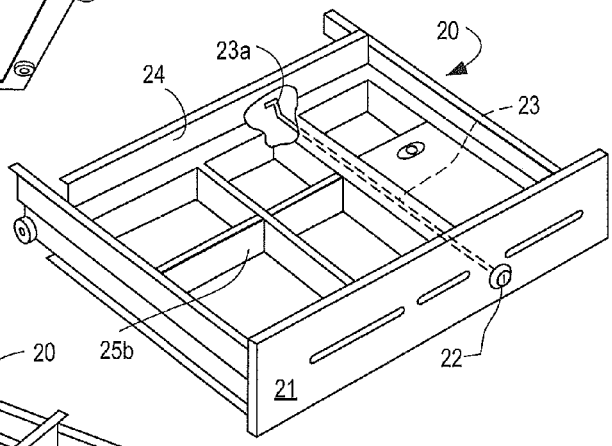
FIG. 3A illustrates a top right front perspective view of the cash drawer with a top cash tray removed.
Figure 3B:
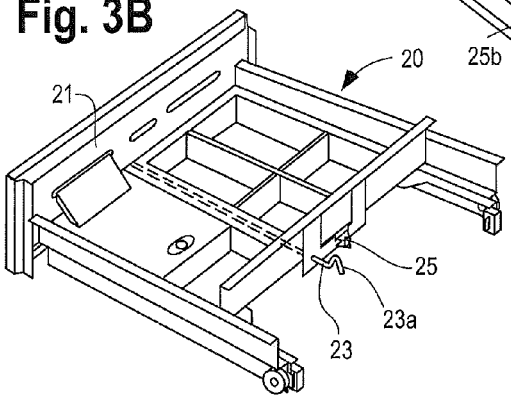
FIG. 3B illustrates a top left rear perspective view of the cash drawer with the top cash tray removed.

In the illustrated example, the front 21 of the cash drawer 20 includes a key-operated lock 22. In the example of FIGS. 3A and 3B, the top cash tray 25*a* is removed from the cash drawer 20, and a rod 23 is seen in phantom underneath part of bottom cash tray 25*b*. Rod 23 extends through the cash drawer 20 underneath the cash trays 25*a* and 25*b* from the lock 22 through the rear 24 of the cash drawer 20. The rod 23 extends out of the rear 24 and terminates with a hook or a bent peripheral end 23*a*. Rod 23 rotates when a key is able to turn in the lock 22, and the peripheral end 23*a* releases a latch mechanism (not shown) inside the rear of case 40 that frees latch bolt 25 and allows the cash drawer 20 to slide outwardly. Pushing the cash drawer 20 all the way back into the case 40 resets the latch mechanism locking the cash drawer 20 in the case 40.

Figure 6A:
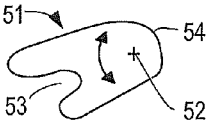
FIG. 6A is a schematic representation of a top view of part of an exemplary latch mechanism.
Figure 6B:
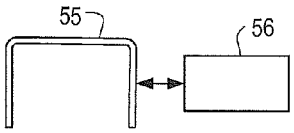
FIG. 6B is a schematic representation of a front view of another part of the exemplary latch mechanism.

FIGS. 6A and 6B are schematic representations of parts of an exemplary latch mechanism. FIG. 6A is a top view of piece 51 that is flat and shaped with a notch 53 at one end and a cam 54 at the other end. It can rotate about a pivot point 52. FIG. 6B is a front view of piece 55 that is U-shaped and can move laterally as indicated by the arrows. Piece 55 is connected by a spring to a post extending up from piece 51. When the cash drawer 20 is closed in case 40, latch bolt 25 engages the notch 53 and bent peripheral end 23*a* of rod 23 fits in piece 55.

One way to open cash drawer 20 is when a key is able to turn in lock 22. In that case, rod 23 rotates and peripheral end 23*a* pushes piece 55 laterally, causing piece 51 to rotate about pivot point 52 from an initial point of stability to an alternate point of stability determined by cam 54. The rotation releases latch bolt 25, and the cash drawer 20 is allowed to slide outwardly. When the cash drawer 20 is pushed all the way back into the case 40, latch bolt 25 fits into notch 53 causing piece 51 to rotate back to the initial point of stability, pulling piece 55 laterally back to its initial position.

Figure 5:
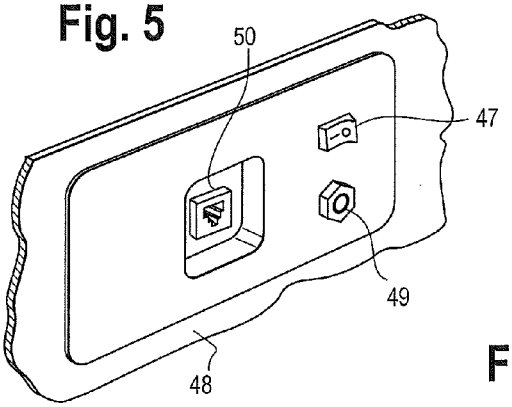
FIG. 5 illustrates a partial rear view of the case.

An alternative way to open cash drawer 20 is when solenoid 56 is powered, pulling piece 55 laterally and again causing piece 51 to rotate and release latch bolt 25. For example, solenoid 56 can be powered from a receipt printer with a signal transmitted through an RJ Series connector jack 50 mounted in a rear 48 of case 40 as shown in FIG. 5.

Other means for locking the cash drawer in the case can be used as is known in the art.

In the illustrated example, a mechanical micro-switch 46 is part of the latch mechanism, and is electrically part of the circuit for connecting power to the illumination source. The switch 46 is electrically closed when piece 55 moves laterally and the latch mechanism is released, and is electrically opened when the latch mechanism is reset. Other means for automatically connecting power to the illumination source when the cash drawer is open and disconnecting power from the illumination source when the cash drawer is locked in the case include, for example, a magnetic reed switch, electronic switching using a micro-processor, and various mechanical, magnetic, optical and infrared switching known in the art.

Figure 4:
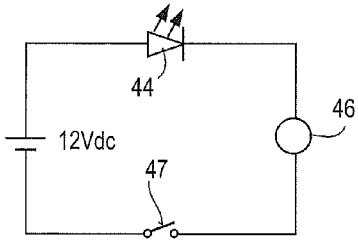
FIG. 4 illustrates a logical wiring scheme of the illustrated embodiment.

In the example illustrated in FIG. 4, there also is a separate on-off switch 47 in the circuit for manual deactivation of the LED light strip 44. In the illustrated example, the separate on-off switch 47 is a mechanical rocker switch mounted in the rear 48 of the case 40, as seen in FIG. 5.

Other means for manually deactivating the circuit include various switches known in the art.

In the illustrated example, LED light strip 44 is rated for an input voltage of 12VDC and total power of 3 W. The power for the LED light strip 44 is supplied through a DC power jack 49 mounted in the rear 48 of the case 40 seen in FIG. 5. Other means for supplying power to the illumination source circuit can be used such as a battery, wall power in conjunction with a transformer and rectifier that are included in the illumination source circuit, or wall power in conjunction with other circuitry that is tailored to the power requirements of the particular illumination source.

In the example illustrated in FIG. 5, an RJ Series connector jack 50 also is mounted in the rear 48 of the case 40 for connections to other devices. As mentioned above, this can be used for connection with a receipt printer to power solenoid 56. It also could be used for other purposes and, in other embodiments, there could be other types of connectors or no other connectors.

From the foregoing, it will be understood that numerous modifications and variations can be effectuated without departing from the true spirit and scope of the novel concepts of the present invention. It is to be understood that no limitation with respect to the specific embodiments illustrated and described is intended or should be inferred.

What is claimed is:

1. An illuminated cash drawer comprising: a cash drawer for holding currency; a case into which the cash drawer fits and in which the cash drawer can be locked closed, a front of the case defining an opening through which the cash drawer slides when the cash drawer is being opened and when the cash drawer is being closed; an LED light source for illuminating the currency in the cash, drawer when the cash drawer is open, the LED light source being mounted only on an inside surface of a top of the case adjacent to and parallel to a front edge of the top; and electric circuitry, the electric circuitry being arranged to provide required power to the LED light source automatically when the cash drawer is open and automatically not to provide power to the LED light source when the cash drawer is closed, the required power being total power and input voltage that are consistent with ratings of the LED light source for causing the LED light source to illuminate, wherein the LED light source is a light-emitting diode (LED) light strip, wherein the LED light strip is mounted adjacent to and parallel to a front edge of the top of the case.

2. The illuminated cash drawer of claim 1, further comprising: mounts that mount the illumination source to the Inside surface of the top of the case; wherein the mounts are integral with respective parts of the case.

3. The illuminated cash drawer of claim 1, further comprising a power source that is designed to provide the required power.

4. The illuminated cash drawer of claim 1, wherein the total power is approximately 3 watts and the input voltage is approximately 12 volts DC.

5. The illuminated cash drawer of claim 1, further comprising: a power jack mounted in the case; wherein the required power is supplied through the power jack.

6. The illuminated cash drawer of claim 1 further comprising: at least one cash tray with at least one partition; wherein a highest one of the partitions is sufficiently lower than a front of the cash drawer to allow clearance under the illumination source when the cash drawer is being opened.

7. The illuminated cash drawer of claim 1, further comprising: a latch mechanism; wherein the latch mechanism prevents the cash drawer from being opened when the cash drawer is locked closed, until an unlocking event causes a physical movement in the latch mechanism that releases the cash drawer to be opened.

8. The illuminated cash drawer of claim 7, further comprising: a key-operated lock; wherein the unlocking event occurs when a key is able to turn in the lock.

9. The illuminated cash drawer of claim 7, further comprising: a solenoid; wherein the unlocking event occurs when the solenoid is powered.

10. The illuminated cash drawer of claim 9, further comprising: a connector jack mounted in the case; wherein power is supplied to the solenoid through the connector jack.

11. The illuminated cash drawer of claim 1, wherein the electric circuitry comprises a switch; the switch is electrically closed automatically when the cash drawer is open; and the switch is electrically open automatically when the cash drawer is closed.

12. The illuminated cash drawer of claim 11, wherein the switch comprises a mechanical micro-switch.

13. The illuminated cash drawer of claim 1, wherein the electric circuitry comprises a manually-operated switch; and the illumination source is deactivated when the switch is electrically open, regardless of whether the cash drawer is open.

14. An illuminated cash drawer comprising: a cash drawer for holding currency; a case into which the cash drawer fits and in which the cash drawer can be locked closed, a front of the case defining an opening through which the cash drawer slides when the cash drawer is being opened and when the cash drawer is being closed; an LED light source mounted on an inside surface of a top of the case; and means for (1) automatically connecting power to the means for providing illumination of the currency in the cash drawer when the cash drawer is open, and (2) for automatically disconnecting power from the LED light source when the cash drawer is closed, wherein the LED light source is a light-emitting diode (LED) light strip, wherein the LED light strip is mounted adjacent to and parallel to a front edge of the top of the case.

* * * * *